US005858122A

United States Patent [19]

Tani et al.

[11] Patent Number: 5,858,122

[45] Date of Patent: Jan. 12, 1999

[54] MATERIALS CAPABLE OF READILY DEVELOPING NATURAL PATINA AND PROCESS FOR PRODUCING THE SAME

[75] Inventors: Toshio Tani; Minoru Igarashi; Hideo Suda, all of Tokyo, Japan

[73] Assignee: The Furukawa Electric Co., Ltd., Tokyo, Japan

[21] Appl. No.: 608,759

[22] Filed: Feb. 29, 1996

Related U.S. Application Data

[63] Continuation of Ser. No. 555,475, Nov. 8, 1995, abandoned.

[30] Foreign Application Priority Data

Nov. 14, 1994 [JP] Japan ..... 6-278723

[51] Int. Cl.[6] ..... C23C 14/04

[52] U.S. Cl. ..... 148/240; 148/243; 148/269; 148/282

[58] Field of Search ..... 148/240, 243, 148/269, 282

[56] References Cited

U.S. PATENT DOCUMENTS

| | | | |
|---|---|---|---|
| 3,152,927 | 10/1964 | Mattsson et al. | 148/269 |
| 3,434,890 | 3/1969 | Aronberg | 148/298 |
| 3,497,401 | 2/1970 | Hanson et al. | 148/269 |
| 3,930,898 | 1/1976 | Cooley | 148/270 |
| 4,560,415 | 12/1985 | Koh et al. | 106/286.3 |
| 5,160,381 | 11/1992 | Gervais | 148/269 |
| 5,282,890 | 2/1994 | Protzer et al. | 148/276 |

*Primary Examiner*—Timothy M. Speer
*Attorney, Agent, or Firm*—Frishauf, Holtz, Goodman, Langer & Chick, P.C.

[57] ABSTRACT

Disclosed is a material capable of readily developing natural patina, comprising a basis material made of Cu or a Cu alloy at least on the surface; and a layer of at least one compound selected from the group consisting of CuCl, CuBr and CuI formed on the surface of said basis material, and also a process for producing such material, which comprises anodizing the surface of a basis material made of Cu or a Cu alloy at least on the surface in an aqueous solution containing at least one kind of halogen ion selected from the group consisting of $Cl^-$, $Br^-$ and $I^-$. This material develops natural patina in a very short time after exposure outdoors.

15 Claims, 1 Drawing Sheet

MATERIALS CAPABLE OF READILY DEVELOPING NATURAL PATINA AND PROCESS FOR PRODUCING THE SAME

This is a continuation application of application Ser. No. 08/555,475, filed Nov. 8, 1995 now abandoned.

BACKGROUND OF THE INVENTION

1. Field of the Invention

The present invention relates to a material capable of readily developing natural patina and to a process for producing the same. More particularly, the present invention relates to a material which develops uniformly, in a short time, natural patina having excellent corrosion resistance and which is useful as building materials such as for roofing, as well as, to an easy and inexpensive process for producing such material.

2. Prior Art

Copper has been long used as building materials such as for roofing because of excellent durability and fire resistance, lightness in weight, ease of machining and freedom from maintenance after working. Today, copper finds wide applications ranging from public buildings, shrines and temples to private residences, partly because copper is available inexpensively with least fluctuation of price.

The reason why copper is used willingly as a building material is, in addition to these excellent properties inherent in copper as described above, that if copper is left to stand under atmospheric conditions for a long time, a patina film is formed spontaneously on the copper surface, and the patina film serves as a protective film to enhance corrosion resistance of the material and also adds dignified and beautiful appearance to the material.

The greatest part of natural patina is a basic copper sulfate ($CuSO_4.3Cu(OH)_2$), and only in some special cases a basic copper chloride and a basic copper carbonate are found.

However, it takes usually from about more than 10 years to about 20 years for the natural patina to grow thick enough to acquire appreciable good appearance. For such reason, there have been proposed various methods for artificially developing patina on the copper surface.

For example, Japanese Patent Publication No. 12117/1980 discloses a method of developing artificial patina on the surface of a copper plate by subjecting the copper plate to anode oxidation in an electrolyte containing $HCO_3^-$ or $CO_3^{2-}$ and NaOH or KOH.

Meanwhile, Japanese Patent Publication No. 9270/1981 discloses a method of developing artificial patina on the surface of a copper plate by contacting the copper plate with a liquid chemical conversion treatment containing hydrochloric acid, copper acetate, a basic copper carbonate, copper nitrate, ammonium chloride or sodium chloride.

Japanese Patent Publication No. 30396/1981 discloses a method in which a resin coating containing a copper powder is applied on the copper surface, followed by a chemical conversion treatment using a liquid treatment containing hydrochloric acid, copper acetate, copper carbonate, arsenious acid, ammonium chloride, copper nitrate or water.

Further, Japanese Unexamined Patent Publication No. 139467/1980 proposes a method of developing aeruginous color by applying a coating incorporated with a basic copper carbonate powder, a kind of patina, on the surface of a basis material. Japanese Patent Publication No. 19910/1987 proposes a method in which an aqueous solution or suspension containing a water-soluble or water-dispersible resin and a compound which forms a complex salt with copper ion is applied on the copper surface.

However, the artificial patina formed according to the above-described methods is, in most cases, of the basic copper carbonate (in the case of anode oxidation) or a basic copper chloride (in the case of chemical conversion treatment), and these methods are hardly capable of forming the basic copper sulfate, the major component of natural patina, on an industrial scale.

Thus, composition of the artificial patina formed according to any of the above-described methods is greatly different from that of natural patina, so that the artificial patina undergoes discoloration or fading with time to lose its decorative savor as patina and also lifts off from the basis material. Besides, copper plates having such artificial patina are expensive.

For such reasons, it has been practiced still, for example in the case of roofing material, to use copper plates as such, instead of using expensive artificially patinated copper plates, to wait until the plates are spontaneously coated with natural patina. However, acid rain falls occasionally in the recent polluted atmospheric condition, so that the period required for development of natural patina is said to be much longer than before. In the case of a private residence, there is a problem that, even if the roof is coated with natural patina after a long period to present appreciable good appearance, the residence as a whole are outworn at that time and needs reconstruction, unfortunately. Accordingly, advent of a material which can develop natural patina at an early stage after roofing is earnestly desired.

OBJECTS AND SUMMARY OF THE INVENTION

It is an objective of the present invention to provide a material which undergoes rusting in a short time to form a uniform film of natural patina containing the basic copper sulfate as a major component.

It is another objective of the present invention to provide a material having an artificial patina layer on the surface to present essentially an aeruginous color, which layer is converted to natural patina with time by subjecting it to exposure outdoors.

It is a further objective of the present invention to provide a method of producing such material easily and thus inexpensively.

In order to attain the objects described above, the present invention provides a material capable of readily developing natural patina, comprising:

a basis material made of Cu or a Cu alloy at least on the surface; and a layer of at least one compound selected from the group consisting of CuCl, CuBr and CuI formed on the surface of the basis material;

wherein the compound layer has a theoretical thickness of at least 0.1 $\mu$m calculated from the quantity of reduced electricity when the layer is subjected to cathodic reduction in a 0.1N aqueous KCl solution (the thus obtained material is hereinafter referred to as Material A).

The present invention also provides a process for producing a material capable of readily developing natural patina (Material A), which comprises:

anodizing the surface of a basis material made of Cu or a Cu alloy at least on the surface in an aqueous solution containing at least one kind of halogen ion selected from the group consisting of $Cl^-$, $Br^-$ and $I^-$ and having a liquid temperature of 20° C. or lower (this process is hereinafter referred to as Process A).

The present invention also provides a material capable of readily developing natural patina, comprising:

a basis material made of Cu or a Cu alloy at least on the surface; and a layer, containing $Cu_2O$ and at least one compound selected from the group consisting of an amorphous compound consisting of Cu and Cl, an amorphous compound consisting of Cu and Br and an amorphous compound consisting of Cu and I, formed on the surface of the basis material (the thus obtained material is hereinafter referred to as Material $B_1$).

The present invention also provides a process for producing a material capable of readily developing natural patina (Material $B_1$), which comprises:

anodizing the surface of a basis material made of Cu or a Cu alloy at least on the surface in an aqueous solution containing at least one kind of halogen ion selected from the group consisting of $Cl^-$, $Br^-$ and $I^-$ and having a liquid temperature of 20° C. or lower to form a layer of at least one compound selected from the group consisting of CuCl, CuBr and CuI on the surface to a theoretical thickness of at least 0.1 μm calculated from the quantity of reduced electricity when the compound layer is subjected to cathodic reduction in a 0.1N aqueous KCl solution; and subjecting the compound layer to hydrolytic treatment (this process is hereinafter referred to as Process $B_1$).

The present invention also provides a material capable of readily developing natural patina, comprising:

a basis material made of Cu or a Cu alloy at least on the surface; and a layer containing $Cu_2O$, a basic copper chloride and an amorphous compound consisting of Cu and Cl formed on the surface of the basis material (the thus obtained material is hereinafter referred to as Material $B_2$).

The present invention also provides a process for producing a material capable of readily developing natural patina (Material $B_2$), which comprises:

anodizing the surface of a basis material made of Cu or a Cu alloy at least on the surface in an aqueous solution containing $Cl^-$ and having a liquid temperature of 20° C. or lower to form a CuCl layer on the surface to a theoretical thickness of at least 0.1 μm calculated from the quantity of reduced electricity when the CuCl layer is subjected to cathodic reduction in a 0.1N aqueous KCl solution;

subjecting the CuCl layer to hydrolytic treatment; and subjecting the thus treated CuCl layer to oxidation treatment (this process is hereinafter referred to as Process $B_2$).

The present invention also provides a material capable of readily developing natural patina, comprising:

a basis material made of Cu or a Cu alloy at least on the surface;

a layer of at least one compound selected from the group consisting of CuCl, CuBr and CuI formed on the surface of the basis material; and an artificial patina layer formed on the compound layer;

wherein the compound layer has a theoretical thickness of at least 0.1 μm calculated from the quantity of reduced electricity when the compound layer is subjected to cathodic reduction in a 0.1N aqueous KCl solution, and the artificial patina layer has a thickness of at least 5 μm (the thus obtained material is hereinafter referred to as Material $C_1$).

The present invention also provides a process for producing a material capable of readily developing natural patina (Material $C_1$), which comprises:

forming an artificial patina layer having a thickness of at least 5 μm on the surface of a basis material made of Cu or a Cu alloy at least on the surface;

anodizing the resulting basis material in an aqueous solution containing at least one kind of halogen ion selected from the group consisting of $Cl^-$, $Br^-$ and $I^-$ and having a liquid temperature of 20° C. or lower to form a layer of at least one compound selected from the group consisting of CuCl, CuBr and CuI at the interface between the artificial patina layer and the surface of the basis material to a theoretical thickness of at least 0.1 μm calculated from the quantity of reduced electricity when the compound layer is subjected to cathodic reduction in a 0.1N aqueous KCl solution (this process is hereinafter referred to as Process $C_1$).

The present invention also provides a material capable of readily developing natural patina, comprising:

a basis material made of Cu or a Cu alloy at least on the surface;

a layer of a mixture of at least one compound selected from the group consisting of CuCl, CuBr and CuI and an artificial patina, having a thickness of at least 5 μm, formed on the surface of the basis material; (the thus obtained material is hereinafter referred to as Material $C_2$).

The present invention also provides a process for producing a material capable of readily developing natural patina (Material $C_2$), which comprises:

subjecting the surface of a basis material made of Cu or a Cu alloy at least on the surface to a first anodizing treatment in an aqueous solution containing at least one kind of halogen ion selected from the group consisting of $Cl^-$, $Br^-$ and $I^-$ and having a liquid temperature of 20° C. or lower to form a layer of at least one compound selected from the group consisting of CuCl, CuBr and CuI on the surface; and subjecting the resulting basis material to a second anodizing treatment in an aqueous solution containing $HCO_3^-$ or in an aqueous solution containing $CO_3^{2-}$ and $HCO_3^-$ to form a layer consisting of a mixture of an artificial patina and the compound and having a thickness of at least 5 μm (this process is hereinafter referred to as Process $C_2$).

BRIEF DESCRIPTION OF THE DRAWINGS

The features of the present invention that are believed to be novel are set forth with particularity in the appended claims. The invention, together with the objects and advantages thereof, may best be understood by reference to the following description of the presently preferred embodiments taken in conjunction with the accompanying drawings in which:

DETAILED DESCRIPTION OF THE INVENTION

Figure 1:
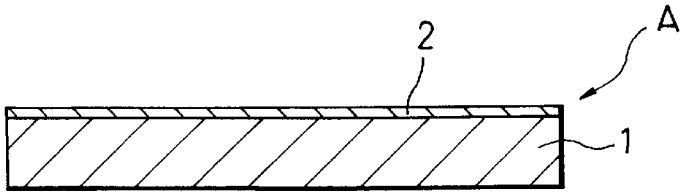
FIG. 1 is a cross-sectional view of Material A according to the present invention.

When a material having a Cu or Cu-alloy surface is exposed to atmospheric condition, the surface of the material is oxidized to loose luster, gradually, and then a film of cuprous oxide ($Cu_2O$) or cupric oxide (CuO) is formed on the surface to induce visual color change to black, reddish orange or brown. If such oxide film is continued to be exposed outdoors for an extended period, it is partially converted very slowly to natural patina which is of a basic copper salt.

According to the studies of the inventors of the present invention, the mechanism of developing natural patina is as follows: The basic copper salt constituting the natural patina is not formed directly from metal copper, but the surface of the metal copper is inevitably oxidized temporarily on the surface to a monovalent $Cu^+$. As a result, a $Cu_2O$ film is formed, and then the oxidation reaction progresses further to develop natural patina.

Accordingly, in order to form a natural patina film in a short time, it is necessary to accelerate the reaction of converting the surface of the O-valent metal copper to $Cu_2O$ as fast as possible.

Incidentally, the reaction that the O-valent metal copper is converted into $Cu_2O$ is of course influenced by the amount of rain, temperature, humidity, the atmospheric composition, the amount of various dusts and bird droppings, and further by oxygen and water content in the atmosphere, as well as, by the chlorine (Cl) content and sulfur (S) content which are also present in the atmosphere in very small amounts.

In any case, according to the studies of the present inventors, it was found that the major medium for forming natural patina is a monovalent $Cu^+$, that is $Cu_2O$.

For such reasons, it is effective to form preliminarily a $Cu_2O$ film on the surface of the basis material in order to develop natural patina thereon in a short time.

Conventionally, it has been generally employed a method of forming a $Cu_2O$ film, in which the copper surface is subjected to chemical conversion treatment using a solution containing, for example, a chloride, a chlorite, an oxidizing agent such as permanganate and a peroxodisulfate, and a pH adjuster.

However, the $Cu_2O$ film formed by means of the above-described chemical conversion treatment method is very thin and has poor adhesion with the basis material, so that it tends to be easily washed off when exposed outdoors, for example, by raining. It occasionally happens that the oxidation reaction further progresses to form CuO film, depending on the exposure environment, to inhibit growth of the desired $Cu_2O$ film. Besides, the speed when the $Cu_2O$ film is formed by the chemical conversion treatment is very slow, and it takes a long time until a $Cu_2O$ film having a desired thickness is formed, leading to very low productivity.

As the method of forming a $Cu_2O$ film, there is also known a technique in which the surface of the basis material is heat-treated in the atmospheric condition.

However, the oxide film formed according to this method is highly dense and stiff, and it is of $Cu_2O$ having high corrosion resistance depending on the thickness. Even in such case, the external portion of the film is oxidized into CuO, requiring a tremendous time for the entire oxide film to be converted into natural patina.

As described above, even if a $Cu_2O$ film is formed directly on the surface of a basis material according to any of the prior art techniques, the resulting film can be hardly converted into natural patina in a short time, and further such material is not satisfactory so as to be used as a roofing material and the like in practical uses.

As shown in FIG. 1, Material A provided according to the present invention consists of a basis material 1 made of Cu or a Cu alloy at least on the surface, and a layer 2 of one or more compounds selected from CuCl, CuBr and CuI formed on the surface of the basis material 1.

The basis material 1 may be entirely of Cu or a Cu alloy or may consist of a core material such as steel, stainless steel, aluminum or a resin which is coated with Cu or a Cu alloy, for example, by means of plating, vapor deposition or cladding. The thickness of the coating layer may be suitably decided in view of factors such as the environment in which the material to be produced is used and weathering resistance required. Incidentally, the Cu alloy includes, for example, Cu—Sn type and Cu—Zn type alloys.

The compound layer 2 is formed according to Production Process A (to be described later) to oxidize Cu on the surface of the basis material directly into monovalent $Cu^+$.

Such layers 2 are all composed of chlorides immediately after formation according to Production Process A (to be described later), but they undergo oxidation and hydrolytic reactions to be converted into $Cu_2O$ or $CuCl_2.3Cu(OH)_2$ (basic copper chloride) upon contact with oxygen and moisture contained in the atmosphere or water, and the thus formed $Cu_2O$ accelerates growth of natural patina.

The Cl component in the compound layer 2 acts to adsorb preferentially and speedily onto the surface of the basis material S components and the like present in the exposure environment, and this action of the Cl component is also supposed to accelerate development of natural patina ($CuSO_4.3Cu(OH)_2$).

Since CuCl, CuBr and CuI all behave the same, it should be appreciated that these compounds are represented by CuCl in the following description.

The speed of each reaction changes depending on the temperature, humidity, as well as, components and their concentrations in the atmosphere.

Ordinary indoor atmosphere and air-conditioned rooms are of low oxidative atmosphere, so that the surface appearance of the basis material having the CuCl layer 2 formed thereon changes relatively slowly by the day or so.

However, when the CuCl layer 2 is exposed to a strong oxidizing atmosphere, for example, to outdoor environment, the surface of the CuCl layer 2 changes speedily from green to deep green immediately after exposure outdoors. After passage of about 24 hours, the color tone of the layer 2 is further deepened to present a uniform appearance. X-ray diffraction analysis of the surface of the colored layer showed that it is of the basic copper chloride.

Further, after passage of one month or so, the desired natural patina color tone of the basic copper sulfate can be visually recognized clearly in the colored layer.

As described above, in Material A, the basic copper chloride is formed on the surface of the basis material in an extremely short time on the order of minutes, hours or about a day, and the basic copper sulfate (natural patina) is finally formed after passage of further one month or so. It conventionally took at least a decade or so for such rusting phenomenon to take place.

The phenomenon that natural patina is developed at a surprisingly high speed in Material A, as described above, is surmised to be generally induced by complex reactions which take place as expressed by the following schemes:

1. Formation of $Cu_2O$ (cuprous oxide) by hydrolytic reaction:

$$2CuCl+H_2O \rightarrow Cu_2O+2HCl \quad (1);$$

2. Formation of $CuCl_2$ (cupric chloride) by disproportionation reaction:

$$2CuCl \rightarrow CuCl_2+Cu \quad (2);$$

3. Formation of $CuCl_2$ (cupric chloride), $Cu(OH)_2$ (copper hydroxide) and CuO (cupric oxide) by oxidation reactions:

$$4CuCl+2H_2O+O_2 \rightarrow 2CuCl_2+2Cu(OH)_2 \quad (3);$$

$$2Cu+2H_2O+O_2 \rightarrow 2Cu(OH)_2 \quad (4);$$

$$2Cu_2O+4H_2O+O_2 \rightarrow 4Cu(OH)_2 \quad (5);$$

$$2Cu+O_2 \rightarrow 2CuO \quad (6);$$

$$CuO+H_2O \rightarrow Cu(OH)_2 \quad (7);$$

4. Formation of $CuCl_2.3Cu(OH)_2$ (basic copper chloride):

$$CuCl_2+3Cu(OH)_2 \rightarrow CuCl_2.3Cu(OH)_2 \quad (8)$$

5. Formation of basic copper sulfate ($CuSO_4.3Cu(OH)_2$) by reaction with a trace of S component present in outdoor environment:

$$4Cu_2O+2SO_2+3O_2+6H_2O \rightarrow 2[CuSO_4.3Cu(OH)_2] \quad (9).$$

If the layer 2, which is gradually converted from the surface layer into the basic copper chloride, is attacked by rain before long after exposure outdoors, the basic copper chloride constituting the surface layer is often washed off partly. The reason why such phenomenon occurs is supposed to be that $Cu_2O$ is gradually formed below the layer 2 which is being converted into the basic copper chloride and that chemically unstable CuCl still remains as such which is induced to undergo hydrolysis by the rain to vigorously accelerate such $Cu_2O$ conversion.

In order to prevent the layer 2 from being washed off, the layer 2 to be formed may be allowed to have a thickness of 0.1 $\mu$m or more as calculated in the following manner:

First, the layer 2 formed on the surface of the basis material 1 is subjected to cathodic reduction in a 0.1N aqueous KCl solution under the condition of a current density i ($mA/cm^2$) to reduce the layer 2 completely therein, and the reduction time t (sec) is calculated to obtain the quantity of reduced electricity C (=i×t:$mC/cm^2$).

Based on the thus obtained quantity of reduced electricity, the thickness (T) of the layer 2 is calculated according to the following equation:

$$T(\mu m)=10 \cdot M \cdot C/n \cdot \rho \cdot F \quad (10).$$

In the above equation, M represents molecular weight of the compound constituting the layer 2, and it is 98.999 g/mol, 143.450 g/mol and 190.450 g/mol in the cases of CuCl layer, CuBr layer and CuI layer, respectively.

Meanwhile, ρ represents specific gravity, and it is 4.14 $g/cm^3$, 4.72 $g/cm^3$ and 5.63 $g/cm^3$ in the cases of CuCl layer, CuBr layer and CuI layer, respectively; and n is electric charge number of $Cu^+$, and n=1 in any cases. F is a Faraday constant.

It should be noted here that, when the layer 2 is a mixture of CuCl, CuBr and CuI, M and ρ are substituted by a weighted mean value calculated corresponding to the mixing ratio.

It should be appreciated that the thickness T to be calculated according to the above equation (10) is referred to as theoretical thickness in the present invention.

However, when the CuCl layer 2 is to be formed according to Production Process A (to be described later), the CuCl layer 2 powders to come off the surface of the basis material, if the CuCl layer 2 has a great theoretical thickness. Accordingly, the upper limit of the theoretical thickness (T) is 2 to 3 $\mu$m.

Even when the basic copper chloride is partly washed off as described above, the desired natural patina is securely be developed finally by continuing the exposure outdoors for 3 to 4 months.

Material A can be produced according to the following Production Process A.

The basis material 1 is immersed in an aqueous solution (to be described later) to serve as an anode, and an insoluble electrode serving as a cathode, such as of stainless steel, platinum and carbon is set in the aqueous solution to carry out anode oxidation of the surface of the basis material, i.e. Cu or a Cu alloy.

When a CuCl layer is to be formed on the surface of the basis material, the aqueous solution is incorporated with a predetermined concentration of $Cl^-$ by dissolving, for example, NaCl, KCl, HCl or $NH_4Cl$; and when a CuBr layer is to be formed, the aqueous solution is incorporated with a predetermined concentration of $Br^-$ by dissolving, for example, NaBr, KBr or $NH_4Br$; whereas when a CuI layer is to be formed, the aqueous solution is incorporated with a predetermined concentration of $I^-$ by dissolving, for example, NaI, KI or $NH_4I$. When a layer consisting of a mixture of CuCl, CuBr and CuI at a predetermined ratio is to be formed, the aqueous solution is prepared by dissolving such ionic sources such that they may assume the predetermined ratio.

It is preferred to also add a pH adjustable agent such as NaOH and $NaCO_3$ to the aqueous solution to adjust the pH value of the aqueous solution to 4 or more. If the anodic oxidation is carried out in the state where pH is less than 4, the resulting CuCl layer cannot be fully prevented from redissolving. A particularly preferred pH value is 7 or more.

Further, it is necessary to maintain the liquid temperature of the bath at 20° C. or lower.

If the anodic oxidation is carried out at a liquid temperature of higher than 20° C., the proportion of copper oxides, particularly of $Cu_2O$, thus formed becomes greater than that of CuCl, and thus the surface nonuniformity is increased with the formation of $Cu_2O$. That is, when the proportion of copper oxide becomes greater, the basic copper chloride cannot be easily formed on the surface to fail to provide a surface which can be converted to natural patina in a short time.

The lower the liquid temperature is, the more uniform becomes the CuCl layer formed. However, to maintain the aqueous solution at an excessively low liquid temperature leads to elevation in the cooling cost, so that it is usually preferred to maintain a liquid temperature of 0° to 15° C.

The anodic current density in carrying out the anodic oxidation is preferably set at 0.1 to 1.5 $A/dm^2$.

If the anodic oxidation is carried out in the state where the current density is lower than 0.1 $A/dm^2$, the speed of forming the CuCl layer becomes very slow, and it takes a prolonged time for securing the theoretical thickness (T) of 0.1 $\mu$m or more, unpractically. Meanwhile, if the current density is higher than 1.5 $A/dm^2$, a passivated film of basic copper chloride is readily formed on the surface of the basis material.

It is preferred to carry out surface roughening of the basis material prior to anodic oxidation. This surface roughening treatment allows the atmospheric components and water content which accelerate the reaction of developing natural patina as expressed by the schemes (1) to (9) to remain on the surface of the material having a CuCl layer formed thereon, when it is subjected to exposure outdoors, and these components promote further development of natural patina.

The degree of surface roughness is preferably 5 $\mu$m or more, in terms of the 10-point average height (Rz) as stipulated by JIS B 0601.

For example, the basic copper sulfate is initially formed in the form of spots which are gradually spread to grow into a film, and the initial spot-like basic copper sulfate tends to appear at the protrusions present on the surface of the basis material. Accordingly, the finer the surface roughness of the basis material is, the higher becomes the speed of forming the basic copper sulfate film, enabling development of natural patina in a short time.

As the technique of surface-roughening the basis material, various methods can be employed, and the sand blasting method or the alternating current electrolytic method is preferably employed in the present invention. The reason is that the surface of the basis material can be allowed to have very fine roughness and that the components which accelerate development of natural patina can be efficiently retained on the surface of the basis material.

The sand blasting method is a mechanical method of imparting roughness to the surface of the desired material by blasting abrasive grains onto the surface of the material and enjoys easy surface roughening procedures, advantageously.

As the abrasive grains, there may be employed those having excellent grinding properties, such as garnet, fused alumina, silicon carbide, steel shot or wire shot of iron or steel as well as sand (siliceous sand) which has been frequently employed conventionally. Those abrasive grains including fused alumina other than siliceous sand are preferred, because they can increase surface roughening efficiency.

As the blaster, various types of apparatuses can be employed. In the present invention, any type of blasters such as of injection type employing compressed air and of projection type utilizing centrifugal force can be employed. Particularly, the suction or direct pressure system injection type blasters are suitable, since they can achieve surface roughening efficiently.

The alternating current electrolytic method is a electrochemical method of electrolyzing the surface of the basis material using an alternating current in an electrolyte and can impart fine roughness to a smooth surface. According to this method, unlike the surface roughening to be achieved by the copper plating method, there is absolutely no need of supplying copper ion, requiring easy procedures.

According to this method, a pair of basis materials to be treated are set in the electrolyte to serve alternately as an anode or a cathode and vice versa periodically. When the basis material serves as the anode, the surface of the basis material is etched when copper is ionized to dissolve from the surface of the basis material into the electrolyte; whereas when it serves as the cathode, the copper ion dissolving in the electrolyte is electrodeposited on the surface of the basis material. In other words, since the surfaces of the basis materials are subjected to etching and electrodeposition alternately, surface roughening can be effected extremely efficiently.

The electrolyte employable here is not particularly limited so long as it can facilitate ionization of Cu on the surface of the basis material to be dissolved therein and is typified, for example, by an ordinary acid such as $H_2SO_4$, an aqueous alkaline solution such as of KCN and an aqueous solution containing an ammonium salt or $NH_4^+$, in which a chelating agent for Cu is dissolved, particularly preferably an aqueous solution containing $Cl^-$ such as NaCl, $NH_4Cl$ and HCl.

This alternating current electrolytic method can realize efficiently surface roughening with no restriction on the pH value of the electrolyte, concentration of the solute, etc., and it can be practiced using an electrolyte in the alkaline region to which aqueous ammonia or NaOH is added. However, when the electrolyte is in the neutral region, it induces elevation in the bath voltage, leading to increased power cost.

Incidentally, while this alternating current electrolytic method may be carried out using a pair of basis materials set to serve as two electrodes, as described above, one of these electrodes may be the basis material to be surface-treated, and the other may be an insoluble electrode such as of SUS, platinum, an oxide electrode (DSE: Dimensionally Stabel Electrode) or a carbon electrode. In the latter case, Cu ion dissolves less into the electrolyte. Further, a basis material to be treated can be interposed between a pair of insoluble electrodes such as carbon electrodes to effect surface roughening by feeding power indirectly.

Next, Material $B_1$ according to the present invention will be described.

Figure 2:
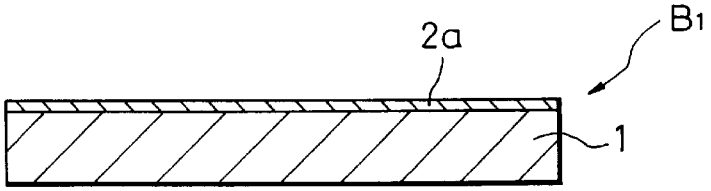
FIG. 2 is a cross-sectional view of Material $B_1$ according to the present invention.

As shown in FIG. 2, Material $B_1$ is of the same layer structure as Material A, except that a layer 2*a* (to be described later) is formed on the surface of the basis material 1.

Material $B_1$ is produced by subjecting the compound layer 2 (see FIG. 1) composed of CuCl, CuBr or CuI as obtained according to Production Process A to hydrolysis (Production Process $B_1$).

The hydrolytic treatment employable here includes spraying of a city water or a deionized water against the layer 2 of Material A shown in FIG. 1; immersion of Material A in water; or exposure of Material A to an atmosphere having a relative humidity of 90% or more. If the water temperature is increased to about 60° C., the hydrolytic reaction of the layer 2 is accelerated suitably. While the treatment time is not particularly limited, it is preferably a period such that the water or moisture retention state or the dew formation state in the layer 2 may be maintained at least for one minute in order to allow the hydrolytic reaction of the layer 2 to take place sufficiently.

When the fully hydrolyzed CuCl layer is then subjected to X-ray diffraction analysis, a diffraction peak of $Cu_2O$ can be obtained, but no peaks of CuCl and $CuCl_2$. When such CuCl layer is subjected to analysis using an EPMA (Electron Probe X-ray Micro analyzer), Cu and Cl can be detected.

Accordingly, when CuCl layer is subjected to hydrolytic treatment immediately after formation of the layer, CuCl is decomposed into $Cu_2O$ and HCl as expressed by the scheme (1). However, the Cl moiety constituting HCl is not supposed to be washed away from the hydrolyzed layer (the layer 2*a* in FIG. 2) but to remain in the greatest part in the form of amorphous compound together with the Cu component.

Since the layer 2*a* contains $Cu_2O$ formed by the reaction of the scheme (1), the layer 2*a* contains a mixture of the amorphous compound and $Cu_2O$.

The layer 2*a* is useful, since the Cl component present in the amorphous state is capable of preferentially capturing $SO_2$, $SO_3^{2-}$, $SO_4^{2-}$, etc. which are present in trace amounts in outdoor environment, and thus Material $B_1$ can develop the basic copper sulfate (natural patina) on the surface of the basis material in a short time compared with Material A.

In the case of Material $B_1$, even when CuCl still remains in the layer 2*a* due to insufficient hydrolytic treatment, it can be sufficiently put into practical uses. For example, when such material $B_1$ is actually used as a roofing material, hydrolysis of the residual CuCl is promoted by raining after working to finally assume a state equal to that where hydrolytic reaction is fully carried out before working in a relatively short time.

Next, Material $B_2$ according to the present invention will be described.

Figure 3:
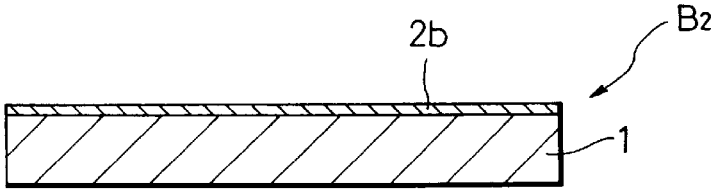
FIG. 3 is a cross-sectional view of Material $B_2$ according to the present invention.

In Material $B_2$, a layer 2*b* (to be described later) is formed on the surface of the basis material 1, as shown in FIG. 3.

In forming this layer 2*b*, Material $B_1$ is first produced by forming a layer 2*a* as a specific layer containing $Cu_2O$ and the amorphous compound of Cu and Cl according to Production Process $B_1$, and the layer 2*a* is subjected to oxidation treatment (Production Process $B_2$).

As the oxidation treatment employable here, while Material $B_1$ may be simply subjected to exposure outdoors, it may be also exposed, for example, to an atmosphere having a relative humidity of 90% and a temperature of 40° C. or higher or an atmosphere containing ultraviolet light or a strong oxidative gas such as ozone. The treatment time required for the exposure, which may depend on the degree of oxidative property of the exposure atmosphere, is generally about 1 to 5 minutes. While the treatment time is not particularly limited, the content of Cl component assuming the amorphous state becomes small if it is too long, and the action of capturing $SO_2$, $SO_3^{2-}$ and $SO_4^{2-}$ described above is lowered to have reduced capability of developing natural patina in a short time.

When the layer 2*a*, containing a mixture of $Cu_2O$ and an amorphous compound of Cu and Cl, having been subjected to oxidation treatment is then subjected to X-ray diffraction analysis, a diffraction peak of $CuCl_2.3Cu(OH)_2$ crystal is recognized in addition to that of $Cu_2O$, but no peak of CuCl. When the layer 2*a* is subjected to EPMA analysis, Cu and Cl can be detected.

Accordingly, the layer 2*b* that is to say, the layer 2*a* subjected to oxidation treatment contains, $Cu_2O$, a basic copper chloride as a kind of natural patina, and the amorphous compound of Cu and Cl.

When Material $B_2$ is exposed outdoors, the composite reactions as expressed by the schemes (2) to (9) take place to develop the desired basic copper sulfate (natural patina) finally on the surface after 3 to 4 months.

Next, Material $C_1$ according to the present invention will be described.

Figure 4:
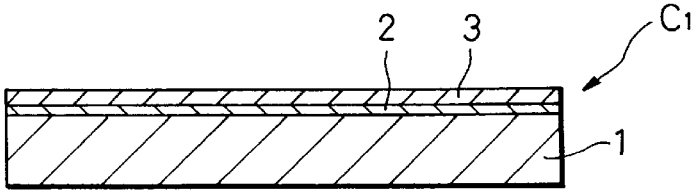
FIG. 4 is a cross-sectional view of Material $C_1$ according to the present invention.

As shown in FIG. 4, Material $C_1$ is composed of a basis material 1, a layer 2 formed on the surface of the basis material 1 and a layer 3 of artificial patina formed on the layer 2.

The layer 2 is of at least one compound selected from the group consisting of CuCl, CuBr and CuI like Material A. The theoretical thickness (T) of the layer 2 is 0.1 $\mu$m or more due to the same reason as in the case of Material A.

It is necessary for the artificial patina layer 3 to have a thickness of 5 $\mu$m or more in order to secure weathering resistance of the material.

Material $C_1$ can be produced in the following manner (Production Process $C_1$).

The artificial patina layer 3 is first formed to a thickness of 5 $\mu$m or more on the surface of the basis material.

As the method of forming the artificial patina layer 3, any conventional method of forming artificial patina may be employed except the method of coating the surface of the basis material with a resin coating admixed with a patina powder. According to the exceptional method, the surface of the basis material is coated with resin to prevent the surface of the basis material from undergoing anodic oxidation to be described later.

Incidentally, if the surface of the basis material is roughened, as described with respect to Production Process A, prior to formation of the artificial patina layer 3, mutual adhesion among the surface of the basis material, the layer 2 (to be described later) and the artificial patina layer 3 is favorably increased.

Subsequently, the basis material is entirely subjected to anodic oxidation treatment under the same conditions as in Production Process A.

In this step, it is preferred to carry out the anodic oxidation until the voltage between the anode (basis material) and a cathode, rises to 25 V or more, because mutual adhesion among the surface of the basis material, the layer 2 and the artificial layer 3 can be enhanced.

The reason is as follows. At the point where anodic oxidation is to be started, the artificial patina layer 3 having insulating property is already formed on the surface of the basis material, so that the voltage between the anode (basis material) and the cathode initially assumes a relatively high level. As the anodic oxidation progresses, a compound layer is gradually formed on the anode (basis material), and the electrode voltage is also increased gradually. The anode (basis material) finally assumes a high electric field to generate a force of pressing the compound layer which is being formed and the artificial patina layer toward the anode (basis material). However, even when the voltage is increased too much, the above-described mutual adhesion assumes a saturated state to increase power cost in vain. Accordingly, the anodic oxidation is particularly preferably carried out at an voltage between electrodes within the range of 25 to 50 V.

Thus, the compound layer 2 of CuCl, CuBr or CuI is formed on the surface of the basis material under the artificial patina layer 3 to a theoretical thickness of 0.1 $\mu$m or more. Thus, Material $C_1$ having the layer 2 interposed at the interface between the surface of the basis material and the artificial patina layer 3.

Since the outermost layer of Material $C_1$ is the artificial patina layer 3, it already presents a beautiful patinated appearance immediately after production. When Material $C_1$ is exposed outdoors, the underlayer compound layer 2 is hydrolyzed gradually with time, and also the layer 2 captures preferentially S and Cl components in the atmosphere and undergoes the reactions as expressed by the schemes (1) to (9) to be converted into natural patina.

Next, Material $C_2$ according to the present invention will be described.

Figure 5:
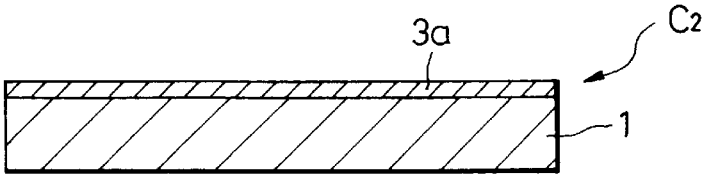
FIG. 5 is a cross-sectional view of Material $C_2$ according to the present invention.

As shown in FIG. 5, Material $C_2$ has a layer 3*a* (to be described later) formed on the surface of a basis material 1.

This layer 3*a* is of a mixture of at least one compound selected from the group consisting of CuCl, CuBr and CuI and the artificial patina as described with respect to Material $C_1$. The layer 3*a* is designed to have a thickness of 5 $\mu$m or more so as to secure weathering resistance of the material.

Material $C_2$ can be produced in the following manner (Production Process $C_2$).

First, the surface of the basis material is anodized (first anodic oxidation) in the same manner as in Production Process A to form the compound layer.

Then, the resulting basis material is subjected to a second anodic oxidation in an aqueous solution to be described later.

The aqueous solution employable here is a $HCO_3^-$-containing solution prepared by dissolving $NaHCO_3$ or $NH_4HCO_3$ in water, or a ($CO_3^{2-}$ and $HCO_3^-$)-containing solution prepared by dissolving $Na_2CO_3$, $(NH_4)_2CO_3$ and $NaHCO_3$ in water.

The basic copper carbonate type artificial patina represented by the formula $CuCO_3.3Cu(OH)_2$ is formed by this second anodic oxidation. In this step, since the theoretical thickness (T) of the compound layer formed already on the surface of the basis material is as very thin as about 2 to 3 μm at most, the artificial patina is formed so as to incorporate the compound layer into it. The second anodic oxidation is carried out until the thickness of the artificial patina layer becomes 5 μm or more.

The second anodic oxidation is preferably carried out until the voltage between the anode (basis material) and the cathode increases to 25 V or more. The reason is as described with respect to Production Process $C_1$.

Since the surface layer of Material $C_2$ is also of the artificial patina, like in the case of Material $C_1$, it already presents a beautiful patinated appearance immediately after production, and when Material $C_2$ is exposed outdoors, the entire layer is gradually converted into natural patina in a short time.

EXAMPLE 1

Material A was produced according to Production Process A as follows.

Tough pitch copper plates of temper ½H stipulated by JIS C 1100 were provided. This tough-pitch copper plates are cold rolled sheets and have dimensions of 65 mm×150 mm×0.4 mm (thickness) (surface area: about 1 $dm^2$ per side) and a surface roughness of about 2 μm in terms of the Rz value.

The tough-pitch copper plates were subjected to anodic oxidation in aqueous solutions and under the conditions as shown in Table 1, respectively. As the cathode, SUS-304 was employed.

Some of the tough-pitch copper plates had been subjected to surface roughening treatment by means of sand blasting or alternating current electrolysis as described below.

Sand blasting method: Fused alumina abrasive materials having grain sizes according to the stipulation of JIS R 6001 (FUJIRANDOM, trade name, manufactured by Fuji Seisakusho Kabushiki-Kaisha) and an injection type sand-blaster (Pneuma-blaster SGK, trade name, manufactured by Fuji Seisakusho Kabushiki-Kaisha) were used to carry out surface roughening. The degree of surface roughness was changed by using as an abrasive material having a grain size of No. 220 or No. 150, using a blasting pressure of 1 $kg/cm^2$ or 3 $kg/cm^2$ and changing the treatment time within the range of 5 to 15 seconds.

Alternating current electrolytic method:

There were used an aqueous hydrochloric acid solution having a concentration of 2.5 $mol/dm^3$ as an electrolyte (liquid temperature: room temperature) and SUS-304 as the-cathode to carry out surface treatment at a frequency of 50 HZ and at a current density of 80 $A/dm^2$ (effective value). A slide transformer manufactured by Toshiba Corporation was used. In this method, the processing time was varied to change the degree of surface roughness.

TABLE 1

| | Surface roughening treatment of copper plate | | | | | | Conditions for anodization | | | |
|---|---|---|---|---|---|---|---|---|---|---|
| | | | Aqueous solution Composition ($mol/dm^3$) | | | | | | | Anodic |
| Sample No. | Treatment method | Rz value (μm) | NaCl | HCl | $NH_4Cl$ | $Na_2CO_3$ | Temperature (°C.) | pH value | Time (minute) | current density ($A/dm^2$) |
| 1 | nil | 2 | 1.0 | — | — | q.s. | 5 | 9 | 5 | 1.5 |
| 2 | nil | 2 | 2.0 | — | — | q.s. | 5 | 9.5 | 5 | 1.5 |
| 3 | nil | 2 | 2.0 | — | — | q.s | 5 | 9.5 | 5 | 2 |
| 4 | nil | 2 | 2.0 | — | — | q.s. | 5 | 9.5 | 5 | 2.5 |
| 5 | nil | 2 | 2.0 | — | — | — | 5 | 6.5 | 5 | 1.5 |
| 6 | nil | 2 | 2.0 | q.s. | — | — | 5 | 3 | 5 | 1.5 |
| 7 | nil | 2 | 1.0 | — | 1.0 | — | 5 | 7 | 5 | 1.5 |
| 8 | nil | 2 | — | — | 2.0 | — | 5 | 8 | 5 | 1.5 |
| 9 | nil | 2 | 2.0 | — | — | q.s. | −2 | 9 | 5 | 1.5 |
| 10 | nil | 2 | 2.0 | — | — | q.s. | 0 | 9.5 | 5 | 1.5 |
| 11 | nil | 2 | 2.0 | — | — | q.s. | 15 | 9.5 | 5 | 1.5 |
| 12 | nil | 2 | 2.0 | — | — | q.s. | 20 | 9.5 | 5 | 1.5 |
| 13 | nil | 2 | 2.0 | — | — | q.s. | 25 | 9.5 | 5 | 1.5 |
| 14 | sand blasting | 4 | 2.0 | — | — | q.s. | 5 | 9.5 | 5 | 1.5 |
| 15 | sand blasting | 5 | 2.0 | — | — | q.s. | 5 | 9.5 | 5 | 1.5 |
| 16 | sand blasting | 10 | 2.0 | — | — | q.s. | 5 | 9.5 | 5 | 1.5 |
| 17 | AC electrolysis | 4 | 2.0 | — | — | q.s. | 5 | 9.5 | 5 | 1.5 |
| 18 | AC electrolysis | 5 | 2.0 | — | — | q.s. | 5 | 9.5 | 5 | 1.5 |
| 19 | AC electrolysis | 10 | 2.0 | — | — | q.s. | 5 | 9.5 | 5 | 1.5 |
| 20 | nil | 2 | 2.0 | — | — | q.s. | 20 | 9.5 | 5 | 0.5 |
| 21 | nil | 2 | — | — | — | — | — | — | — | — |

The theoretical thickness (T) of the CuCl layer formed on the surface of the copper plate of each anodized sample was calculated.

The surface of each copper plate was also visually observed immediately after the anodic oxidation treatment to evaluate appearance of the copper plate, in accordance with the following evaluation criteria:

⊙: The surface is very uniform and neat.

○: The surface is uniform and good.

Δ: The surface is passivated or nonuniform.

Each sample was further exposed outdoors to carry out outdoor exposure test in accordance with the stipulation of JIS K 5400 to visually observe color change on the surface of the sample. Further, in the course of exposure, the surface of each sample was analyzed periodically (once a month) using an X-ray diffractometer (manufactured by RIGAKU Kabushiki-Kaisha) to find out if natural patina (basic copper sulfate) is formed or not. The time point when natural patina was developed is defined as the time until natural patina is first observed.

Meanwhile, each sample was further exposed outdoors to investigate how long it takes until the sample changes to aeruginous color uniformly over the entire surface, which is defined as the time until natural patina is uniformly developed.

The results of the above tests are summarized in Tables 2-1 and 2-2.

TABLE 2-1

| Sample No. | Theoretical thickness of CuCl layer (μm) | Evaluation of appearance immediately after anodizattion | Results of exposure outdoors: Time until color change (visual) | Time until natural patina is first observed (X-ray diffractory) | Time (years) until natural patina is uniformly developed (visual) |
|---|---|---|---|---|---|
| 1 | 0.6 | ⊙ | immediately after exposure | 10 months | 3.0 |
| 2 | 1.0 | ⊙ | immediately after exposure | 10 months | 3.0 |
| 3 | 1.0 | ○ | immediately after exposure | 1 year | 3.5 |
| 4 | 0.5 | Δ (passivated) | immediately after exposure | 2.5 years | 7.0 |
| 5 | 0.3 | ○ | immediately after exposure | 1 year | 4.5 |
| 6 | 0.1 | Δ (nonuniform) | immediately after exposure | 2 years | 7.0 |
| 7 | 0.5 | ○ | immediately after exposure | 1 year | 4.0 |
| 8 | 0.5 | ○ | immediately after exposure | 1 year | 4.0 |
| 9 | 1.5 | ⊙ | immediately after exposure | 10 months | 3.0 |
| 10 | 1.5 | ⊙ | immediately after exposure | 10 months | 3.0 |

TABLE 2-2

| Sample No. | Theoretical thickness of CuCl layer (μm) | Evaluation of appearance immediately after anodizattion | Results of exposure outdoors: Time until color change (visual) | Time until natural patina is first observed (X-ray diffractory) | Time (years) until natural patina is uniformly developed (visual) |
|---|---|---|---|---|---|
| 11 | 0.8 | ⊙ | immediately after exposure | 10 months | 3.0 |
| 12 | 0.4 | ○ | immediately after exposure | 1 year | 5.0 |
| 13 | 0.1 | Δ (nonuniform) | immediately after exposure | 3 years | 9.0 |
| 14 | 1.1 | ⊙ | immediately after exposure | 9 months | 3.0 |
| 15 | 1.2 | ⊙ | immediately after exposure | 5 months | 2.0 |
| 16 | 1.5 | ⊙ | immediately after exposure | 4 months | 2.0 |
| 17 | 1.0 | ⊙ | immediately after exposure | 9 months | 3.0 |
| 18 | 1.1 | ⊙ | immediately after exposure | 4 months | 2.0 |
| 19 | 1.7 | ⊙ | immediately after exposure | 3 months | 1.0 |
| 20 | 0.07 | ○ | immediately after exposure | 5 years | 14 |
| 21 | — | lustrous | 2 months (became lusterless | 13 years | 20 |

As is clear from Tables 1, 2-1 and 2-2, the time until natural patina is first observed is greatly reduced in Sample Nos. 1 to 19 compared with the untreated copper plate (Sample No. 21).

Sample No. 20 took 5 years until natural patina is first observed and as very long as 14 years until natural patina was uniformly developed. The reason is that the theoretical thickness of the CuCl layer formed by the anodic oxidation was thinner than 0.1 μm, and it was 0.07 μm. When the CuCl layer has a theoretical thickness of 0.1 μm, the time until natural patina is first observed is at least halved compared with Sample No. 21 (untreated copper plate), as demonstrated by Sample Nos. 6 and 13.

When the liquid temperature of the aqueous solution employed in the anodic oxidation is higher than 15° C. (Sample Nos. 11 to 13), the time until patina is uniformly developed is acceleratively extended. Particularly in the case of Sample No. 13, where the liquid temperature is 25° C., the thickness of the CuCl layer to be formed is greatly reduced, and further $Cu_2O$ is formed to present nonuniform appearance. Besides, the time until patina is uniformly formed is extended to 9 years. There is not so much difference in the performance of developing natural patina if the liquid temperature is below 0° C. (Sample No. 9) or 0° C. (Sample No. 10). Accordingly, in view of cooling cost, the liquid temperature in the anodic oxidation is preferably 0° to 20° C., particularly preferably 0° to 15° C.

As in the cases of Sample Nos. 2 to 4, the time until natural patina is uniformly developed is extended as the anodic current density is increased. Particularly when the current density exceeds 2.5 A/dm$^2$ (Sample No. 4), a passivated film is formed on some part of the copper plate surface to extend considerably the time until natural patina is first observed. Accordingly, the current density in the anodic oxidation is preferably set to 1.5 A/dm$^2$ or lower so as to securely prevent formation of passivated film.

When pH value of the aqueous solution is low (Sample No. 6), redissolution of the CuCl layer formed occurs to reduce the thickness of the CuCl layer to 0.1 $\mu$m, so that the time until natural patina is uniformly formed is extended. It can be understood that, in order to secure a theoretical thickness of 1.0 $\mu$m or more for the CuCl layer, the aqueous solution is preferably designed to have a pH value of 4 or more, particularly 7 or more. Accordingly, it is preferred to use, as the aqueous solution for the anodic oxidation, one having such a composition as to easily maintain the above-described pH value.

Both the time until natural patina is first observed and the time until natural patina is uniformly observed of those having an Rz value of 5 $\mu$m or more (Sample Nos. 15, 16, 18 and 19) are relatively reduced over the others. In the samples having an Rz value of about 10 $\mu$m, difference manifests itself depending on the surface roughening method employed. More specifically, when the copper plate is subjected to surface roughening by means of alternating current electrolysis (Sample No. 19), natural patina was developed uniformly after one-year exposure outdoors, which is shorter than in Sample No. 16 which was subjected to sand blasting. The reason is that the roughness formed by the alternating current electrolysis is extremely fine.

When a copper plate as used in Example 1 was immersed in a liquid chemical conversion treatment containing a $Cl^-$ type oxidizing agent to analyze the surface of the plate by X-ray diffractory, it was found that $Cu_2O$ is mainly formed with no uniform formation of CuCl layer, unlike in each Example.

EXAMPLE 2

A CuBr layer or a CuI layer was formed on the same tough-pitch copper plates as used in Example 1 according to the specifications shown in Table 3, respectively. The thus obtained samples were subjected to outdoor exposure tests in the same manner as in Example 1 to examine surface change. The results are summarized in Table 3.

TABLE 3

| | Surface roughening treatment of copper plate | | Aqueous solution | | | Conditions for anodization | | | | Evaluation | Results of exposure outdoors | | |
|---|---|---|---|---|---|---|---|---|---|---|---|---|---|
| Sample No. | Treatment method | Rz value ($\mu$m) | Composition (ml/dm$^3$) KBr | KI | $Na_2CO_3$ | Temperature (°C.) | pH value | Anodic current density (A/dm$^2$) | Theoretical thickness of CuBr or CuI layer ($\mu$m) | of appearance immediately after anodization | Time until color change (visual) | Time until natural patina is first observed (X-ray diffractory) | Time (years until natural patina is uniformly developed (visual) |
| 22 | nil | 2 | 2.0 | — | q.s. | 5 | 9.5 | 1.5 | 0.9 | ⊙ | immediately after exposure | 1.5 years | 5.0 |
| 23 | AC electrolysis | 10 | 2.0 | — | q.s. | 5 | 9.5 | 1.5 | 1.4 | ⊙ | immediately after exposure | 9 months | 2.5 |
| 24 | nil | 2 | — | 2.0 | q.s. | 5 | 9.5 | 1.5 | 0.8 | ⊙ | immediately after exposure | 2 years | 6.0 |
| 25 | AC electrolysis | 10 | — | 2.0 | q.s. | 5 | 9.5 | 1.5 | 1.2 | ⊙ | immediately after exposure | 11 months | 3.5 |

As is clear from Table 3, the time until natural patina is first observed in any of Sample Nos. 22 to 25 is greatly reduced compared with the untreated copper plate (Sample No. 21), but is slightly extended compared with the cases where the CuCl layer is formed (e.g. Example Nos. 2 and 9).

EXAMPLE 3

Material $B_1$ was produced according to Production Process $B_1$ as follows.

Specifically, there were provided phosphorus-deoxidized copper plates of temper ½H as stipulated by JIS C 1201 which are of the same dimensions as those used in Example 1. The surface of each copper plate was subjected to anodic electrolysis in accordance with the specifications shown in Table 4 such that a CuCl layer having the theoretical thickness as shown in Table 4 may be formed to provide Material A as an intermediate product.

TABLE 4

| Sample No. | Surface roughening treatment of copper plate: Treatment method | Rz value (μm) | Aqueous solution Composition (mol/dm³): NaCl | HCl | $NH_4Cl$ | $Na_2CO_3$ | Conditions of anodization: Temperature | pH value | Anodic current density (A/dm²) | Theoretical thickness of CuCl layer (μm) | Remarks |
|---|---|---|---|---|---|---|---|---|---|---|---|
| 26 | nil | 2 | 2.0 | — | — | q.s. | 5 | 9.5 | 1 | 1.0 | |
| 27 | nil | 2 | 2.0 | — | — | q.s. | 5 | 9.5 | 1.5 | 1.0 | Equal to Sample No. 2 |
| 28 | nil | 2 | 2.0 | — | — | q.s. | 5 | 9.5 | 2 | 1.0 | Equal to Sample No. 3 |
| 29 | nil | 2 | 2.0 | — | — | q.s. | 5 | 9.5 | 2.5 | 0.5 | Equal to Sample No. 4 |
| 30 | nil | 2 | 2.0 | — | — | — | 5 | 6.5 | 1 | 0.3 | |
| 31 | nil | 2 | 2.0 | q.s. | — | — | 5 | 3 | 1 | 0.1 | |
| 32 | nil | 2 | 1.0 | — | 1.0 | — | 5 | 7 | 1 | 0.5 | |
| 33 | nil | 2 | — | — | 2.0 | — | 5 | 8 | 1 | 0.5 | |
| 34 | nil | 2 | 2.0 | — | — | q.s. | −2 | 9.5 | 1 | 1.5 | |
| 35 | nil | 2 | 2.0 | — | — | q.s. | 0 | 9.5 | 1 | 1.5 | |
| 36 | nil | 2 | 2.0 | — | — | q.s. | 15 | 0.5 | 1 | 0.8 | |
| 37 | nil | 2 | 2.0 | — | — | q.s. | 20 | 9.5 | 1 | | |
| 38 | nil | 4 | 2.0 | — | — | q.s. | 25 | 9.5 | 1 | 0.1 | |
| 39 | sand blasting | 2 | 2.0 | — | — | q.s. | 5 | 9.5 | 1 | 1.1 | |
| 40 | sand blasting | 5 | 2.0 | — | — | q.s. | 5 | 9.5 | 1 | 1.2 | |
| 41 | sand blasting | 10 | 2.0 | — | — | q.s. | 5 | 9.5 | 1 | 1.5 | |
| 42 | AC electrolysis | 4 | 2.0 | — | — | q.s. | 5 | 9.5 | 1 | 1.0 | |
| 43 | AC electrolysis | 5 | 2.0 | — | — | q.s. | 5 | 9.5 | 1 | 1.1 | |
| 44 | AC electrolysis | 10 | 2.0 | — | — | q.s. | 5 | 9.5 | 1 | 1.7 | |
| 45 | AC electrolysis | 10 | 2.0 | — | — | q.s. | 5 | 9.5 | 1 | 1.7 | |
| 46 | nil | 2 | 2.0 | — | — | q.s. | 20 | 9.5 | 0.1 | 0.07 | |

A deionized water warmed to 50° C. was sprayed onto the surfaces of the samples to allow them to assume a water-retention state for 5 minutes to effect hydrolysis of the CuCl layer to complete Production Process $B_1$.

The thus obtained samples were each subjected to X-ray diffraction analysis at the surface layer immediately after production to identify products formed or was applied to EDX analyzer (energy dispersive X-ray spectrometer) to detect intralayer components. At the end point of the anodic oxidation (before hydrolysis), the appearance of each sample was evaluated based on the same criteria as in Example 1.

Further, each sample was subjected to exposure outdoors in the same manner as in Example 1 to measure the time until natural patina is first observed and the time until natural patina is uniformly developed.

The results are summarized in Table 5.

TABLE 5

| Sample No. | Evaluation of appearance immediately after anodizattion | Analytical data of surface layer immediately after production: Components identified by X-ray diffractors | Components detected by EDX elmentary analysis | Results of exposure outdoors: Time until natural patina is first observed (X-ray diffractory) | Time (years) until natural patina is uniformly developed (visual) |
|---|---|---|---|---|---|
| 26 | ◎ | Cu, $Cu_2O$ | Cu, Cl | 10 months | 3.0 |
| 27 | ◎ | Cu, $Cu_2O$, $CuCl_2.3Cu(OH)_2$ | Cu, Cl | 10 months | 3.0 |
| 28 | ○ | Cu, $Cu_2O$ | Cu, Cl | 1 year | 3.5 |
| 29 | Δ (passivated) | Cu, $Cu_2O$ | Cu, Cl | 2.5 years | 7.0 |
| 30 | ○ | Cu, $Cu_2O$ | Cu, Cl | 1 year | 4.5 |
| 31 | Δ (nonuniform) | Cu, $Cu_2O$ | Cu, Cl | 2 years | 7.0 |
| 32 | ○ | Cu, $Cu_2O$ | Cu, Cl | 1 year | 4.0 |
| 33 | ○ | Cu, $Cu_2O$ | Cu, Cl | 1 year | 4.0 |

TABLE 5-continued

| Sample No. | Evaluation of appearance immediately after anodizattion | Analytical data of surface layer immediately after production: Components identified by X-ray diffractors | Components detected by EDX elmentary analysis | Results of exposure outdoors: Time until natural patina is first observed (X-ray diffractory) | Time (years) until natural patina is uniformly developed (visual) |
|---|---|---|---|---|---|
| 34 | ◎ | Cu, $Cu_2O$ | Cu, Cl | 10 months | 3.0 |
| 35 | ◎ | Cu, $Cu_2O$ | Cu, Cl | 10 months | 3.0 |
| 36 | ◎ | Cu, $Cu_2O$ | Cu, Cl | 10 months | 3.0 |
| 37 | ○ | Cu, $Cu_2O$ | Cu, Cl | 1 year | 5.0 |
| 38 | Δ (nonuniform) | Cu, $Cu_2O$ | Cu, Cl | 3 years | 9.0 |
| 39 | ◎ | Cu, $Cu_2O$ | Cu, Cl | 9 months | 3.0 |
| 40 | ◎ | Cu, $Cu_2O$ | Cu, Cl | 5 months | 2.0 |
| 41 | ◎ | Cu, $Cu_2O$ | Cu, Cl | 4 months | 2.0 |
| 42 | ◎ | Cu, $Cu_2O$ | Cu, Cl | 9 months | 3.0 |
| 43 | ◎ | Cu, $Cu_2O$ | Cu, Cl | 4 months | 2.0 |
| 44 | ◎ | Cu, $Cu_2O$ | Cu, Cl | 3 months | 1.0 |
| 45 | ◎ | Cu, $Cu_2O$, CuCl (trace) | Cu, Cl | 3 months | 1.0 |
| 46 | ○ | Cu, $Cu_2O$ (trace) | Cu, Cl | 5 years | 14 |

As is clear from Tables 4 and 5, Material $B_1$ obtained according to Production Process $B_1$ can develop natural patina in a short time like Material A.

In the case where hydrolysis is not fully effected (Sample No. 45), i.e. where CuCl still remains, the surface of the copper plate was coated with natural patina after one-year exposure outdoors, demonstrating that CuCl is of no hindrance.

As the analytical data of the surface layer demonstrate, when the CuCl layer formed by the anodic oxidation is subjected to hydrolysis, the thus treated layer is converted into a layer containing $Cu_2O$ and an amorphous compound of Cu and Cl.

EXAMPLE 4

A CuBr layer or a CuI layer was formed on the surfaces of the phosphorus-deoxidized copper plates as used in Example 3 in accordance with the specifications as shown in Table 6, and the thus formed CuBr or CuI layer was subjected to hydrolysis in the same manner as in Example 3. The thus obtained samples were subjected to surface layer analysis and outdoor exposure tests in the same manner as in Example 3.

The results are summarized in Table 6.

TABLE 6

| Sample No. | Surface roughening treatment of copper plate: Treatment method | Rz value (μm) | Aqueous solution Composition (mol/dm³): KBr | KI | $Na_2CO_3$ | Conditions for anodization: Temperature (°C.) | pH value | Anodic current density (A/dm²) | Theoretical thickness of CuBr or CuI layer (μm) | Evaluation of appearance immediately after anodization |
|---|---|---|---|---|---|---|---|---|---|---|
| 47 | nil | 2 | 2.0 | — | q.s. | 5 | 9.5 | 1 | 0.9 | ◎ |
| 48 | AC electrolysis | 10 | 2.0 | — | q.s. | 5 | 9.5 | 1 | 1.4 | ◎ |
| 49 | nil | 2 | — | 2.0 | q.s. | 5 | 9.5 | 1 | 0.8 | ◎ |
| 50 | AC electrolysis | 10 | — | 2.0 | q.s. | 5 | 9.5 | 1 | 1.2 | ◎ |

| Sample No. | Analytical data of surface layer immediately after production: Components identified by X-ray diffractory | Components detected by EDX elementary analysis | Results of exposure outdoors: Time until color change (visual) | Time until natural patina is first observed (X-ray diffractory) | Time (years) until natural patina is uniformly developed (visual) |
|---|---|---|---|---|---|

TABLE 6-continued

| | | | | | |
|---|---|---|---|---|---|
| 47 | Cu, $Cu_2O$ | Cu, Br | immediately after exposure | 1.5 years | 5.0 |
| 48 | Cu, $Cu_2O$ | Cu, Br | immediately after exposure | 9 months | 2.5 |
| 49 | Cu, $Cu_2O$ | Cu, I | immediately after exposure | 2 years | 6.0 |
| 50 | Cu, $Cu_2O$ | Cu, I | immediately after exposure | 11 months | 3.5 |

As is clear from Table 6, even when the surface of the copper plate is anodized to form a CuBr layer or a CuI layer, which is then subjected to hydrolysis, the resulting material developed natural patina in a short time.

However, the time until natural patina is first observed is slightly extended compared with the cases where CuCl layer is formed.

EXAMPLE 5

Material $B_2$ was produced according to Production Process $B_2$ as follows.

Specifically, Sample Nos. 26, 31, 41, 44, 45 and 46 of all Samples shown in Tables 4 and 5 were further subjected to exposure under atmospheric condition at a relative humidity of 80% and at a temperature of 60° C. to effect oxidation treatment, followed to hydrolysis.

The surface layer of each sample immediately after the treatment was analyzed in the same manner as in Example 4 and subjected to outdoor exposure tests in the same manner as in Example 3. The results are summarized in Table 7.

TABLE 7

| | | Analytical data of surface layer immediately after production | | Results of exposure outdoors | |
|---|---|---|---|---|---|
| Sample No. | Sample No. before oxidation treatment | Components identified by X-ray diffractory | Components detected by EDX elmentary analysis | Time until natural patina is first observed (X-ray diffractory) | Time (years) until natural patina is uniformly developed (visual) |
| 51 | 26 | Cu, $Cu_2O$, $CuCl_2.3Cu(OH)_2$ | Cu, Cl | 10 months | 3.0 |
| 52 | 31 | Cu, $Cu_2O$ | Cu, Cl | 2 years | 7.0 |
| 53 | 41 | Cu, $Cu_2O$, $CuCl_2.3Cu(OH)_2$ | Cu, Cl | 4 months | 2.0 |
| 54 | 44 | Cu, $Cu_2O$, $CuCl_2.3Cu(OH)_2$ | Cu, Cl | 3 months | 1.0 |
| 55 | 45 | Cu, $Cu_2O$, CuCl (trace), $CuCl_2.3Cu(OH)_2$ (trace) | Cu, Cl | 3 months | 1.0 |
| 56 | 46 | Cu, $Cu_2O$ (trace), $CuCl_2.3Cu(OH)_2$ (trace) | Cu, Cl | 3 months | 1.0 |

As is clear from Table 7, in the cases where the hydrolyzed CuCl layer was further subjected to oxidation treatment, the basic copper chloride is formed in the resulting layer, and the layer as a whole is composed of $Cu_2O$, the basic copper chloride and an amorphous compound of Cu and Cl.

As is clear in a comparison between the data of Table 7 and those of Table 5, even when Material $B_1$ is further subjected at the surface to oxidation treatment to be converted to Material $B_2$, the time until natural patina is first observed is reduced.

EXAMPLE 6

Material $C_1$ was produced according to Production Process $C_1$ as follows.

The phosphorus-deoxidized copper plates as used in Example 3 were spray-coated with a liquid chemical conversion treatment having a composition of $CuSO_4.5H_2O$: 10 g/dm$^3$, $NH_4Cl$: 20 g/dm$^3$, NaCl: 30 g/dm$^3$ and tartaric acid: 10 g/dm$^3$ to form an artificial patina layer having a thickness as shown in Tables 8-1, 8-2 and 8-3 respectively.

Some of the copper plates were subjected to anodic oxidation using a pH 8 electrolyte (liquid temperature 25° C.) containing 0.3 mol/dm$^3$ of ammonium hydrogencarbonate, 0.3 mol/dm$^3$ of ammonium carbamate and 0.005 mol/dm$^3$ of ammonium molybdate at an anodic current density of 20 A/dm$^2$ until the bath voltage rises 45 V to form artificial patina layers on the surfaces of the copper plates to a thickness as shown in Tables 8-1, 8-2 and 8-3, respectively.

Subsequently, each copper plate was subjected to anodic oxidation in an aqueous solution of the composition as indicated in Tables 8-1, 8-2 and 8-3 such that a CuCl layer having the theoretical thickness as indicated in Tables 8-1, 8-2 and 8-3 may be formed. In this step, the voltage between the copper plate and the cathode (SUS-304) was constantly measured to terminate the anodization treatment at the point when the voltage reached the specified level. The cross section of each of the resulting samples was microscopically observed to measure the entire thickness of the layer thus formed, and also the structure of the layer was observed.

Conditions and specifications under which each sample was produced are summarized in Tables 8-1, 8-2 and 8-3.

TABLE 8-1

| | Surface roughening treatment of copper plate | | Artificial patina layer | | Conditions for anodization | | | | | | | | | |
|---|---|---|---|---|---|---|---|---|---|---|---|---|---|---|
| Sample No. | Treatment method | Rz value (μm) | Formation method | Thickness (μm) | Composition of aqueous solution (mol/dm³) NaCl | HCl | $NH_4Cl$ | $Na_2CO_3$ | Temperature (°C.) | pH value | Anodic current density (A/dm²) | Voltage (V) between electrodes at the end of treatment | Theoretical thickness of CuCl layer (μm) | Layer structure |
| 57 | nil | 2 | chemical conversion treatment | 15 | 1.0 | — | — | q.s. | 5 | 9 | 1.5 | 25 | 0.6 | CuCl and artificial patina are laminated on Cu in this order |
| 58 | nil | 2 | chemical conversion treatment | 17 | 2.0 | — | — | q.s. | 5 | 9.5 | 1.5 | 25 | 1.0 | CuCl and artificial patina are laminated on Cu in this order |
| 59 | nil | 2 | chemical conversion treatment | 5 | 2.0 | — | — | q.s. | 5 | 9.5 | 1.5 | 25 | 1.0 | CuCl and artificial patina are laminated on Cu in this order |
| 60 | nil | 2 | chemical conversion treatment | 13 | 2.0 | — | — | q.s. | 5 | 9.5 | 1.5 | 20 | 0.8 | CuCl and artificial patina are laminated on Cu in this order |
| 61 | nil | 2 | chemical conversion treatment | 12 | 2.0 | — | — | q.s. | 5 | 9.5 | 1.5 | 30 | 1.2 | CuCl and artificial patina are laminated on Cu in this order |
| 62 | nil | 2 | chemical conversion treatment | 15 | 2.0 | — | — | q.s. | 5 | 9.5 | 2 | 25 | 1.0 | CuCl and artificial patina are laminated on Cu in this order |
| 63 | nil | 2 | chemical conversion treatment | 16 | 2.0 | — | — | q.s. | 5 | 9.5 | 2.5 | 25 | 0.5 | CuCl and artificial patina are laminated on Cu in this order |
| 64 | nil | 2 | chemical conversion treatment | 13 | 2.0 | — | — | q.s. | 5 | 6.5 | 1.5 | 25 | 0.3 | CuCl and artificial patina are laminated on Cu in this order |

TABLE 8-2

| | Surface roughening treatment of copper plate | | Artificial patina layer | | Conditions for anodization | | | | | | | | | |
|---|---|---|---|---|---|---|---|---|---|---|---|---|---|---|
| Sample No. | Treatment method | Rz value (μm) | Formation method | Thickness (μm) | Composition of aqueous solution (mol/dm³) NaCl | HCl | $NH_4Cl$ | $Na_2CO_3$ | Temperature (°C.) | pH value | Anodic current density (A/dm²) | Voltage (V) between electrodes at the end of treatment | Theoretical thickness of CuCl layer (μm) | Layer structure |
| 65 | nil | 2 | chemical conversion treatment | 10 | 2.0 | q.s. | — | — | 5 | 3 | 1.5 | 25 | 0.1 | CuCl and artificial patina are laminated on Cu in this order |
| 66 | nil | 2 | chemical conversion treatment | 14 | 1.0 | — | 1.0 | — | 5 | 7 | 1.5 | 25 | 0.5 | CuCl and artificial patina are laminated on Cu in this order |
| 67 | nil | 2 | chemical conversion treatment | 15 | — | — | 2.0 | — | 5 | 8 | 1.5 | 25 | 0.5 | CuCl and artificial patina are laminated on Cu in this order |
| 68 | nil | 2 | chemical conversion treatment | 15 | 2.0 | — | — | q.s. | −2 | 9.5 | 1.5 | 25 | 1.5 | CuCl and artificial patina are laminated on Cu in this order |
| 69 | nil | 2 | chemical conversion treatment | 14 | 2.0 | — | — | q.s. | 0 | 9.5 | 1.5 | 25 | 1.5 | CuCl and artificial patina are laminated on Cu in this order |
| 70 | nil | 2 | chemical conversion treatment | 15 | 2.0 | — | — | q.s. | 15 | 9.5 | 1.5 | 25 | 0.8 | CuCl and artificial patina are laminated on Cu in this order |

TABLE 8-2-continued

| Sample No. | Surface roughening treatment of copper plate: Treatment method | Surface roughening treatment of copper plate: Rz value (μm) | Artificial patina layer: Formation method | Artificial patina layer: Thickness (μm) | Conditions for anodization: Composition of aqueous solution (mol/dm³): NaCl | HCl | $NH_4Cl$ | $Na_2CO_3$ | Temperature (°C.) | pH value | Anodic current density (A/dm²) | Voltage (V) between electrodes at the end of treatment | Theoretical thickness of CuCl layer (μm) | Layer structure |
|---|---|---|---|---|---|---|---|---|---|---|---|---|---|---|
| 71 | nil | 2 | chemical conversion treatment | 15 | 2.0 | — | — | q.s. | 20 | 9.5 | 1.5 | 25 | 0.4 | CuCl and artificial patina are laminated on Cu in this order |
| 72 | nil | 2 | chemical conversion treatment | 16 | 2.0 | — | — | q.s. | 25 | 9.5 | 1.5 | 25 | 0.1 | CuCl and artificial patina are laminated on Cu in this order |

TABLE 8-3

| Sample No. | Surface roughening treatment of copper plate: Treatment method | Surface roughening treatment of copper plate: Rz value (μm) | Artificial patina layer: Formation method | Artificial patina layer: Thickness (μm) | Conditions for anodization: Composition of aqueous solution (mol/dm³): NaCl | HCl | $NH_4Cl$ | $Na_2CO_3$ | Temperature (°C.) | pH value | Anodic current density (A/dm²) | Voltage (V) between electrodes at the end of treatment | Theoretical thickness of CuCl layer (μm) | Layer structure |
|---|---|---|---|---|---|---|---|---|---|---|---|---|---|---|
| 73 | nil | 2 | anodization | 20 | 2.0 | — | — | q.s. | 5 | 9.5 | 1.5 | 25 | 1.0 | CuCl and artificial patina are laminated on Cu in this order |
| 74 | sand blasting | 10 | chemical conversion treatment | 15 | 2.0 | — | — | q.s. | 5 | 9.5 | 1.5 | 25 | 1.1 | CuCl and artificial patina are laminated on Cu in this order |
| 75 | sand blasting | 10 | anodization | 22 | 2.0 | — | — | q.s. | 5 | 9.5 | 1.5 | 25 | 1.7 | CuCl and artificial patina are laminated on Cu in this order |
| 76 | nil | 2 | chemical conversion treatment | 13 | 2.0 | — | — | q.s. | 20 | 9.5 | 0.5 | 14 | 0.07 | CuCl and artificial patina are laminated on Cu in this order |
| 77 | nil | 2 | chemical conversion treatment | 3.5 | 2.0 | — | — | q.s. | 5 | 9.5 | 1.5 | 25 | 1.0 | CuCl and artificial patina are laminated on Cu in this order |
| 78 | nil | 2 | chemical conversion treatment | 15 | — | — | — | — | — | — | — | — | — | artificial patina is laminated on Cu |

The surface of each sample was visually observed to evaluate appearance based on the following evaluation criteria:

⊙: The surface is very uniform and neat.

○: The surface is uniform and good.

Δ: The surface is nonuniform.

×: The layer is lifted off.

A test piece (30 mm×30 mm) was cut out of each sample to carry out adhesion test by bending it by 180° in accordance with the method stipulated by JIS G 3312 to observe the layer lifting state and evaluate adhesion of the layer.

Evaluation criteria are as follows:

○: The layer is intact.

5: The layer is cracked but not lifted off.

4: The layer is lifted off very slightly in spots.

3: The layer is slightly lifted off.

2: About a half of the layer is lifted off.

1: About ⅔ of the layer is lifted off.

×: The layer is entirely lifted off.

Further, the samples were subjected to outdoor exposure tests in the same manner as in Example 3 to investigate the time until natural patina is first observed and the time until natural patina is uniformly developed. The results are summarized in Table 9.

TABLE 9

| Sample No. | Evaluation of appearance | Results of adhesion test | Results of exposure outdoors: Time until natural patina is first observed (X-ray diffractory) | Time (years) until natural patina is uniformly developed (visual) |
|---|---|---|---|---|
| 57 | ⊙ | 5 | 2.5 years | 6.0 |
| 58 | ⊙ | 5 | 2 years | 5.0 |
| 59 | ○ | 5 | 2 years | 5.0 |
| 60 | ⊙ | 4 | 2 years | 5.5 |
| 61 | ⊙ | ○ | 2 years | 5.0 |

TABLE 9-continued

| Sample No. | Evaluation of appearance | Results of adhesion test | Results of exposure outdoors: Time until natural patina is first observed (X-ray diffractory) | Time (years) until natural patina is uniformly developed (visual) |
|---|---|---|---|---|
| 62 | ○ | 4 | 3.5 years | 7.0 |
| 63 | Δ (nonuniform) | 3 | 14 years | 9.5 |
| 64 | ○ | 5 | 3.5 years | 8.5 |
| 65 | Δ (nonuniform) | 3 | 4.5 years | 10.0 |
| 66 | ○ | 4 | 3.5 years | 7.0 |
| 67 | ○ | 4 | 3 years | 6.5 |
| 68 | ◎ | 5 | 1.5 years | 4.0 |
| 69 | ◎ | 5 | 1.5 years | 4.0 |
| 70 | ◎ | 5 | 3 years | 6.0 |
| 71 | ○ | 4 | 3.5 years | 7.5 |
| 72 | Δ (nonuniform) | 2 | 4.5 years | 11.5 |
| 73 | ◎ | 5 | 2 years | 5.5 |
| 74 | ◎ | ○ | 1 year | 4.0 |
| 75 | ◎ | ○ | 1 year | 4.0 |
| 76 | ○ | 3 | 7 years (artificial patina partly lifted off.) | 15 |
| 77 | Δ (nonuniform) | 2 | 3.5 years (artificial patina lifted off and discolored.) | 12 (the appearance was not neat until natural patina is uniformly formed.) |
| 78 | — | 2 | after the artificial patina underwent discoloration and lifting off, the brown surface of the basis material appeared. | |

As is clear from Tables 8-1, 8-2 and 8-3, samples of Material $C_1$ produced according to Production Process $C_1$ all have a layer structure in which a CuCl layer is formed on the surface of the copper plate, and an artificial patina layer is formed on the CuCl layer. Accordingly, the surface of Material $C_1$ already presents beautiful aeruginous color immediately after production.

As can be appreciated from Table 9, the artificial patina layer was lifted off in Sample No. 78, and no development of natural patina was observed. However, Material $C_1$ of Sample Nos. 57 to 75 developed natural patina uniformly, and the time until natural patina is first observed is reduced compared with Sample No. 21 (untreated copper plate) as indicated in Tables 2-1 and 2-2 of Example 1.

Meanwhile, in the case of Sample No. 76, the time until natural patina is first observed is as very long as 7 years compared with the others. The reason is that the theoretical thickness of the CuCl layer formed by the anodic oxidation is as thin as 0.07 μm, so that the layer exhibited a weak action of capturing the S components in the atmosphere. However, by securing a theoretical thickness of 0.1 μm for the CuCl layer, the time until natural patina is first observed can be substantially halved as demonstrated by Sample No. 65.

Although natural patina is uniformly developed finally in the case of Sample No. 77, the artificial patina layer was lifted off in a short time after exposure outdoors, because it has a thickness of less than 5 μm, so that the surface state of the copper plate was not neat until natural patina was uniformly developed.

EXAMPLE 7

Artificial patina layers were formed on the copper plates as used in Example 6 using the chemical conversion treatment as used in Example 6, followed by anodic oxidation under the conditions as specified in Table 10 to form a CuBr layer and a CuI layer, respectively. The resulting samples were evaluated in the same manner as in Example 6. The results are summarized in Table 10.

TABLE 10

| Sample No. | Surface roughening treatment of copper plate: Treatment method | Rz value (μm) | Artificial patina layer: Formation method | Thickness (μm) | Conditions for anodization: Composition of aqueous solution (mol/dm³): KBr | KI | $Na_2CO_3$ | Temperature (°C.) | pH value | Anodic current density (A/dm²) | Voltage (V) between electrodes at the end of treatment | Theoretical thickness of CuBr or CuI layer (μm) |
|---|---|---|---|---|---|---|---|---|---|---|---|---|
| 79 | nil | 2 | chemical conversion treatment | 11 | 2.0 | — | q.s. | 5 | 9.5 | 1 | 25 | 0.9 |
| 80 | sand blasting | 10 | chemical conversion treatment | 12 | 2.0 | — | q.s. | 5 | 9.5 | 1 | 25 | 1.4 |
| 81 | nil | 2 | chemical conversion treatment | 15 | — | 2.0 | q.s. | 5 | 9.5 | 1 | 25 | 0.8 |
| 82 | sand blasting | 10 | chemical conversion treatment | 14 | — | 2.0 | q.s. | 5 | 9.5 | 1 | 25 | 1.2 |

| Sample No. | Evaluation of appearance | Results of adhesion test | Results of exposure outdoors: Time until natural patina is first observed (X-ray diffractory) | Time (years) until natural patina is uniformly developed (visual) |
|---|---|---|---|---|
| 79 | ◎ | 5 | 4 years | 7.5 |
| 80 | ◎ | 5 | 3.5 years | 6 |

TABLE 10-continued

| | | | | |
|---|---|---|---|---|
| 81 | ◎ | 5 | 4.5 years | 8 |
| 82 | ◎ | 5 | 4 years | 6.5 |

As is clear from Table 10, even in the cases where a CuBr layer or a CuI layer is formed, natural patina was developed uniformly in 6 to 8 years. However, compared with the samples having a CuCl layer, the samples shown in Table 10 took longer until natural patina is uniformly formed.

EXAMPLE 8

Material $C_2$ was produced according Production Process $C_2$ as follows.

Copper plates as used in Example 6 were subjected to the first anodic oxidation under the same conditions for Sample No. 2 in Example 1 to form a CuCl layer having a theoretical thickness of 1.0 μm.

Subsequently, the thus treated copper plates were immersed in a pH 8 aqueous solution (liquid temperature 25° C.) containing 0.3 mol/dm$^3$ of ammonium hydrogencarbonate, 0.3 mol/dm$^3$ of ammonium carbamate and 0.005 mol/dm$^3$ of ammonium molybdate at an anodic current density of 20 A/dm$^2$ until the voltage rises 45 V to form artificial patina layers on the surfaces of the copper plates to a thickness as shown in Table 11, respectively.

Samples thus obtained were evaluated in the same manner as in Example 6. The results are summarized in Table 11.

TABLE 11

| Sample No. | Thickness of artificial patina (μm) | Evaluation of appearance | Results of adhesion test | Results of exposure outdoors: Time until natural patina is first observed (X-ray diffractory) | Results of exposure outdoors: Time (years) until natural patina is uniformly developed (visual) |
|---|---|---|---|---|---|
| 83 | 20 | ○ | 5 | 1.5 years | 5.0 |
| 84 | 5 | ○ | 5 | 1.5 years | 5.5 |
| 85 | 4 | ○ | 3 | 3 years (discolored appearance) | artificial patina layer lifted off with no fixation of natural patina |

As is clear from Table 11, Material $C_2$ samples were coated uniformly with natural patina in a short time. However, as Sample No. 85 demonstrated, lifting off of the artificial patina layer occurred when the entire thickness of the layer is smaller than 5 μm, with no fixation of natural patina.

It should be apparent to those skilled in the art that the present invention may be embodied in many other specific forms without departing from the spirit or scope of the invention. Therefore, the present examples and embodiments are to be considered as illustrative and not restrictive, and the invention is not to be limited to the details given herein, by may be modified within the scope of the appended claims.

What is claimed is:

1. A process for producing a material capable of readily developing natural patina, which comprises:

anodizing the surface of a basis material made of Cu or a Cu alloy at least on the surface in an aqueous solution containing at least one kind of halogen ion selected from the group consisting of $Cl^-$, $Br^-$ and $I^-$ and having a liquid temperature of 20° C. or lower.

2. The process according to claim 1, wherein said anodizing treatment is carried out at an anodic current density of 0.1 to 1.5 A/dm$^2$.

3. The process according to claim 1, wherein said aqueous solution has a pH value of 4 or higher.

4. A process for producing a material capable of readily developing natural patina, which comprises:

anodizing the surface of a basis material made of Cu or a Cu alloy at least on the surface in an aqueous solution containing at least one kind of halogen ion selected from the group consisting of $Cl^-$, $Br^-$ and $I^-$ and having a liquid temperature of 20° C. or lower to form a layer of at least one compound selected from the group consisting of CuCl, CuBr and CuI on the surface to a theoretical thickness of at least 0.1 μm calculated from the quantity of reduced electricity when the compound layer is subjected to cathodic reduction in a 0.1N aqueous KCl solution; and subjecting said compound layer to hydrolytic treatment.

5. The process according to claim 4, wherein said anodizing treatment is carried out at an anodic current density of 0.1 to 1.5 A/dm$^2$.

6. The process according to claim 4, wherein said aqueous solution has a pH value of 4 or higher.

7. A process for producing a material capable of readily developing natural patina, which comprises:

anodizing the surface of a basis material made of Cu or a Cu alloy at least on the surface in an aqueous solution containing $Cl^-$ and having a liquid temperature of 20° C. or lower to form a CuCl layer on the surface to a theoretical thickness of at least 0.1 μm calculated from the quantity of reduced electricity when said CuCl layer is subjected to cathodic reduction in a 0.1N aqueous KCl solution;

subjecting said CuCl layer to hydrolytic treatment; and subjecting the thus treated CuCl layer to oxidation treatment.

8. The process according to claim 7, wherein said anodizing treatment is carried out at an anodic current density of 0.1 to 1.5 A/dm$^2$.

9. The process according to claim 7, wherein said aqueous solution has a pH value of 4 or higher.

10. A process for producing a material capable of readily developing natural patina, which comprises:

forming an artificial patina layer having a thickness of at least 5 μm on the surface of a basis material made of Cu or a Cu alloy at least on the surface;

anodizing the resulting basis material in an aqueous solution containing at least one kind of halogen ion selected from the group consisting of $Cl^-$, $Br^-$ and $I^-$ and having a liquid temperature of 20° C. or lower to form a layer of at least one compound selected from the group consisting of CuCl, CuBr and CuI at the interface between said artificial patina layer and the surface of said basis material to a theoretical thickness of at least 0.1 μm calculated from the quantity of reduced electricity when the compound layer is subjected to cathodic reduction in a 0.1N aqueous KCl solution.

11. The process according to claim 10, wherein said anodizing treatment is carried out at an anodic current density of 0.1 to 1.5 $A/dm^2$.

12. The process according to claim 10, wherein said aqueous solution has a pH value of 4 or higher.

13. A process for producing a material capable of readily developing natural patina, which comprises:

subjecting the surface of a basis material made of Cu or a Cu alloy at least on the surface to a first anodizing treatment in an aqueous solution containing at least one kind of halogen ion selected from the group consisting of $Cl^-$, $Br^-$ and $I^-$ and having a liquid temperature of 20° C. or lower to form a layer of at least one compound selected from the group consisting of CuCl, CuBr and CuI on said surface; and subjecting the resulting basis material to a second anodizing treatment in an aqueous solution containing $HCO_3^-$ or in an aqueous solution containing $CO_3^{2-}$ and $HCO_3^-$ to form a layer consisting of a mixture of an artificial patina and the compound and having a thickness of at least 5 $\mu$m on the surface.

14. The process according to claim 13, wherein said first anodizing treatment is carried out at an anodic current density of 0.1 to 1.5 $A/dm^2$.

15. The process according to claim 13, wherein said second anodizing treatment is carried out until the voltage between an anode and a cathode rises up to 25 V or more.

* * * * *